US006515033B2

(12) United States Patent
Moore, Jr. et al.

(10) Patent No.: US 6,515,033 B2
(45) **Date of Patent: *Feb. 4, 2003**

(54) METHODS FOR OPTIMIZING FISCHER-TROPSCH SYNTHESIS HYDROCARBONS IN THE DISTILLATE FUEL RANGE

(75) Inventors: Richard O. Moore, Jr., San Rafael, CA (US); Roger D. Van Gelder, Beaconsfield (GB)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/854,196

(22) Filed: May 11, 2001

(65) Prior Publication Data

US 2002/0169219 A1 Nov. 14, 2002

(51) Int. Cl.[7] ..... C07C 27/00; C07C 5/13; C10G 35/06

(52) U.S. Cl. ..... 518/700; 518/702; 585/734; 585/750; 208/136

(58) Field of Search ..... 518/700, 702; 585/734, 750; 208/136

(56) References Cited

U.S. PATENT DOCUMENTS

| | | | |
|---|---|---|---|
| 4,414,423 | A | 11/1983 | Miller |
| 4,417,086 | A | 11/1983 | Miller |
| 4,417,087 | A | 11/1983 | Miller |
| 4,417,088 | A | 11/1983 | Miller |
| 4,423,268 | A | 12/1983 | Miller |
| 4,423,269 | A | 12/1983 | Miller |
| 4,465,788 | A | 8/1984 | Miller |
| 4,511,746 | A | 4/1985 | Miller |
| 4,538,012 | A | 8/1985 | Miller |
| 4,542,251 | A | 9/1985 | Miller |
| 4,551,438 | A | 11/1985 | Miller |
| 4,568,663 | A | 2/1986 | Mauldin |
| 4,608,450 | A | 8/1986 | Miller |
| 5,536,687 | A | 7/1996 | Ward |
| 5,750,819 | A | 5/1998 | Wittenbrink et al. |
| 5,885,438 | A | 3/1999 | Apelian et al. |
| 5,925,235 | A | 7/1999 | Habib |
| 5,929,297 | A | 7/1999 | Theriot et al. |
| 5,942,642 | A | 8/1999 | Beyer et al. |
| 5,993,643 | A | 11/1999 | Chang et al. |
| 6,002,060 | A | 12/1999 | Sarin et al. |
| 6,013,851 | A | 1/2000 | Verrelst et al. |
| 6,030,921 | A | 2/2000 | Ziemer |
| 6,051,127 | A | 4/2000 | Moureaux |
| 6,075,061 | A | 6/2000 | Wittenbrink et al. |
| 6,093,672 | A | 7/2000 | Winquist et al. |
| 6,096,940 | A | 8/2000 | Wittenbrink et al. |
| 6,149,799 | A | 11/2000 | Raybaud et al. |
| 6,168,768 | B1 | 1/2001 | Alexion et al. |

FOREIGN PATENT DOCUMENTS

| | | |
|---|---|---|
| EP | 0609079 A1 | 8/1994 |
| EP | 0921184 A1 | 6/1999 |
| WO | 99/37736 | 7/1999 |
| WO | 00/00571 | 1/2000 |
| WO | WO 00/42119 A1 | 7/2000 |

*Primary Examiner*—Jafar Parsa
(74) *Attorney, Agent, or Firm*—Burns, Doane, Swecker & Mathis, L.L.P.

(57) ABSTRACT

An integrated process for producing a hydrocarbon stream including $C_{5-20}$ normal and iso-paraffins is disclosed. The process involves isolating a non-sulfur containing methane stream and a sulfur-containing $C_5$+ stream from a natural gas source. The methane stream is converted to syngas and further reacted to form a higher molecular weight hydrocarbon product stream. The $C_{5-20}$ hydrocarbons in that product stream are hydroprocessed along with at least a portion of the $C_5$+ stream from the natural gas source. The presence of sulfur in the $C_5$+ stream minimizes the hydrogenolysis that would otherwise occur if the $C_{5-20}$ hydrocarbons were hydroprocessed without added sulfur-containing compounds or other hydrocracking suppressants. The result is an improved yield of $C_{5-20}$ hydrocarbons relative to when the hydroprocessing step does not include hydrocracking suppressants.

16 Claims, No Drawings

METHODS FOR OPTIMIZING FISCHER-TROPSCH SYNTHESIS HYDROCARBONS IN THE DISTILLATE FUEL RANGE

FIELD OF THE INVENTION

This invention is generally in the area of the Fischer-Tropsch synthesis.

BACKGROUND OF THE INVENTION

The majority of fuel today is derived from crude oil. Crude oil is in limited supply, and fuel derived from crude oil tends to include nitrogen-containing compounds and sulfur-containing compounds, which are believed to cause environmental problems such as acid rain.

Although natural gas includes some nitrogen- and sulfur-containing compounds, methane can be readily isolated in relatively pure form from natural gas using known techniques. Many processes have been developed which can produce fuel compositions from methane. Most of these process involve the initial conversion of methane to synthesis gas ("syngas").

Fischer-Tropsch chemistry is typically used to convert the syngas to a product stream that includes a broad spectrum of products, ranging from methane to wax, which includes a significant amount of hydrocarbons in the distillate fuel range ($C_{5-20}$).

Methane tends to be produced when chain growth probabilities are low. The methane can be recirculated through the syngas generator, but minimizing methane formation is generally preferred. Heavy products with a relatively high selectivity for wax are produced when chain growth probabilities are high. The wax can be processed to form lower molecular weight products.

The hydrocarbons in the distillate fuel range are mostly linear, and tend to have relatively low octane values, relatively high pour points and relatively low sulfur contents. They are often isomerized to provide products with desired octane and pour point values.

Many isomerization catalysts require low levels of sulfur and nitrogen impurities, and feedstreams for these catalysts are often hydrotreated to remove the sulfur and nitrogen compounds. Feeds to be isomerized are often contacted with a sulfur-tolerant catalyst in the presence of hydrogen to minimize the amount of sulfur in the feed.

When isomerization processes are carried out with un-sulfided catalysts, various side reactions, such as hydrogenolysis (hydrocracking), can occur, producing undesired $C_1$-$_4$ hydrocarbons. Such hydrogenolysis can be supressed by incorporating a small amount of sulfur-containing compounds into the feed, or by using other hydrocracking suppressants.

It would be advantageous to provide an efficient process for isomerizing the hydrocarbons in the distillate fuel range from Fischer-Tropsch syntheses that minimizes the amount of hydrogenolysis. The present invention provides such a process.

SUMMARY OF THE INVENTION

An integrated process for producing a hydrocarbon stream including $C_{5-20}$ normal and iso-paraffins is disclosed. The process involves isolating a methane stream from a natural gas source, wherein the methane stream is treated to remove sulfur-containing impurities. A $C_5$+ stream is also isolated from the natural gas source, wherein the $C_5$+ stream includes sulfur-containing impurities. At least a portion of the methane stream into converted into syngas, and the syngas is subjected to a hydrocarbon synthesis process, for example, Fischer-Tropsch synthesis, to produce a product stream including $C_{5-20}$ hydrocarbons, among other products. The $C_{5-20}$ stream is then isolated, for example, by fractional distillation or solvent extraction.

At least a portion of the $C_{5-20}$ stream from the syngas reaction is combined with at least a portion of the $C_5$+ stream from the natural gas source. The combined streams are subjected to hydroprocessing conditions which involve hydrotreating and hydroisomerizing the hydrocarbons over an acidic catalyst. At least one of the catalyst components is a pre-sulfided catalyst, for example, a pre-sulfided Group VIII non-noble metal or tungsten catalyst.

The sulfur compounds present in the $C_5$+ stream act as a hydrocracking suppressant, and minimize the amount of hydrocracking (hydrogenolysis) which would otherwise occur during the hydroprocessing reaction and form undesired $C_4$-products. After the hydroprocessing step, any remaining sulfur compounds can be removed, for example, using adsorption, extractive Merox or other means well known to those of skill in the art.

The hydroprocessing catalysts can include cobalt and/or molybdenum in catalytically effective amounts. The acidic component can be a silica-alumina support, where the silica/alumina ratio (SAR) is less than 1 (wt./wt.). For pre-sulfided catalysts, the amount of sulfur is typically between about 0.1 and 10 wt %.

In one embodiment, Fischer-Tropsch wax products are also isolated, and are treated to provide a $C_{5-20}$ product stream. This stream can also be hydroprocessed in combination with at least a portion of the $C_5$+ stream from the natural gas and, optionally, in combination with at least a portion of the $C_{5-20}$ product stream from the Fischer-Tropsch synthesis.

In another embodiment, at least a portion of the $C_{2-4}$ products from the Fischer-Tropsch reaction are subjected to further processing steps, for example olefin oligomerization, to provide an additional $C_{5-20}$ product stream. This product stream can also be hydroprocessed in combination with at least a portion of the $C_5$+ stream from the natural gas, and, optionally, in combination with at least a portion of the $C_{5-20}$ product stream from the Fischer-Tropsch synthesis and/or the product stream resulting from the processing of the Fischer-Tropsch wax.

The processes described herein significantly reduce hydrogenolysis, resulting in a significant increase in the overall yield of $C_{5-20}$ hydrocarbons.

DETAILED DESCRIPTION OF THE INVENTION

An integrated process for producing a hydrocarbon stream including $C_{5-20}$ normal and iso-paraffins is disclosed. The process involves isolating a non-sulfur containing methane stream and a sulfur-containing $C_5$+ stream from a natural gas source. The methane stream is converted to syngas and further reacted to form a higher molecular weight hydrocarbon product stream. The $C_{5-20}$ hydrocarbons in that product stream are hydroprocessed along with at least a portion of the $C_5$+ stream from the natural gas source. The presence of sulfur in the $C_5$+ stream minimizes the hydrogenolysis that would otherwise occur if the $C_{5-20}$ hydrocarbons were hydroprocessed without added sulfur-containing compounds or other hydrocracking suppressants. The result is an improved yield of $C_{5-20}$ hydrocarbons relative to when the hydroprocessing step does not include hydrocracking suppressants. As used herein, carbon number ranges for hydrocarbons are indicated using "Cn" designations: $C_5^+$ indicates a carbon number of 5 or higher, $C_{5-20}$ indicates a carbon range between 5 and 20, inclusively, $C_{2-4}$ indicates a carbon range between 2 and 4 inclusively, $C_{20}$ indicates a carbon number of 20, etc.

According to the invention, natural gas is sent to a separator to separate methane, a $C_2$+ hydrocarbon stream, and sulfur-containing impurities. The methane is sent to a gas-to-liquids plant, which includes a syngas generator, a Fischer-Tropsch synthesis process, and a process upgrading reactor which performs the hydroprocessing reactions. $C_{5-20}$ hydrocarbons are isolated, and $C_4$-hydrocarbons and sulfur-containing impurities are recycled through the separator. The catalysts, reactants, reaction conditions and methods for isolating desired compounds are discussed in more detail below.

Natural Gas

In addition to methane, natural gas includes some heavier hydrocarbons (mostly $C_{2-5}$ paraffins) and other impurities, e.g., mercaptans and other sulfur-containing compounds, carbon dioxide, nitrogen, helium, water and non-hydrocarbon acid gases. Natural gas fields also typically contain a significant amount of $C_5$+ material, which is liquid at ambient conditions. While these liquids must be upgraded (e.g., sulfur removed) if they are to be used directly as liquid petroleum fuels, they are not upgraded in the process described herein until after they are combined with Fischer-Tropsch $C_{5-20}$ hydrocarbons and subjected to hydroprocessing conditions.

The methane and/or ethane can be isolated and used to generate syngas. Various other impurities can be readily separated. Inert impurities such as nitrogen and helium can be tolerated. The methane in the natural gas can be isolated, for example in a demethanizer, and then de-sulfurized and sent to a syngas generator. The $C_2$+ products can then be separated, for example, in a de-ethanizer to provide ethane and a $C_3$+ product stream. Propane, n-butane and iso-butane can be isolated, for example in a turbo-expander, with the propane and butanes separated using a depropanizer.

The remaining products (known as a "natural gas condensate") are primarily $C_5$+ hydrocarbons, and include a suitable quantity of sulfur-containing compounds for use as a hydrocracking suppressant in subsequent hydroprocessing chemistry. Alternatively, the $C_{1-4}$ hydrocarbons can be separated from the $C_5$+ gas condensate stream using other known techniques, such as FLEXSORB® followed by ZnO and/or massive Ni to remove sulfur. Other techniques known to those skilled in the art for sulfur removal may also be used.

Syngas

Methane (and/or ethane) can be sent through a conventional syngas generator to provide synthesis gas. Higher molecular weight hydrocarbons tend to coke the syngas generator and are therefore not preferred. Typically, synthesis gas contains hydrogen and carbon monoxide, and may include minor amounts of carbon dioxide and/or water. When iron-containing catalysts are used for Fischer-Tropsch synthesis, the ratio of hydrogen/carbon monoxide is preferably between about 0.5 and 1.0, preferably around 0.5. When cobalt-containing catalysts are used (for example, cobalt/ruthenium catalysts), the ratio of hydrogen/carbon monoxide is preferably greater than 1.0, more preferably between about 1.0 and 2.0, still more preferably between about 1.0 and 1.5. A hydrogen/carbon monoxide ratio of 1.0 or less results in the formation of a relatively large proportion of oxygenated products, and for this reason, should be avoided.

The presence of sulfur, nitrogen, halogen, selenium, phosphorus and arsenic contaminants in the syngas is undesirable. For this reason, it is preferred to remove sulfur and other contaminants from the feed before performing the Fischer-Tropsch chemistry or other hydrocarbon synthesis. Means for removing these contaminants are well known to those of skill in the art. For example, ZnO guard beds are preferred for removing sulfur impurities. Means for removing other contaminants are well known to those of skill in the art.

Fischer-Tropsch Synthesis

Catalysts and conditions for performing Fischer-Tropsch synthesis are well known to those of skill in the art, and are described, for example, in EP 0 921 184 A1, the contents of which are hereby incorporated by reference in their entirety.

In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of about from 300 to 700° F. (149 to 371° C.) preferably about from 400° to 550° F. (204° to 228° C.); pressures of about from 10 to 600 psia, (0.7 to 41 bars) preferably 30 to 300 psia, (2 to 21 bars) and catalyst space velocities of about from 100 to 10,000 cc/g/hr., preferably 300 to 3,000 cc/g/hr.

The products range from $C_1$ to $C_{200}$+ with a majority in the $C_5$ to $C_{100}$+ range. The reaction can be conducted in a variety of reactor types for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP0609079, also completed incorporated herein by reference for all purposes.

Suitable Fischer-Tropsch catalysts comprise on or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known and illustrative, but nonlimiting examples may be found, for example, in U.S. Pat. No. 4,568,663.

The products from Fischer-Tropsch reactions performed in slurry bed reactors generally include a light reaction product and a waxy reaction product. The light reaction product (a predominantly $C_{5-20}$ fraction, commonly termed the "condensate fraction") includes hydrocarbons boiling below about 700° F.(e.g., tail gases through middle distillates), with decreasing amounts up to about $C_{30}$. The waxy reaction product (a predominantly $C_{20}$+ fraction, commonly termed the "wax fraction") includes hydrocarbons boiling above about 600° F. (e.g., vacuum gas oil through heavy paraffins), with decreasing amounts down to $C_{10}$. Both the light reaction product and the waxy product are substantially paraffinic. The waxy product generally comprises greater than 70% normal paraffins, and often greater than 80% normal paraffins. The light reaction product comprises paraffinic products with a significant proportion of alcohols and olefins. In some cases, the light reaction product may comprise as much as 50%, and even higher, alcohols and olefins.

In the process, at least a portion of the product stream from the hydrocarbon synthesis is blended with at least a portion of the natural gas condensate, to prepare a stream containing less than about 200 ppm sulfur. A preferred product stream from the hydrocarbon synthesis includes $C_{5-20}$ hydrocarbons.

Hydroprocessing

At least a portion of the $C_{5-20}$ normal paraffins from the Fischer-Tropsch reaction are combined with at least a portion of the $C_5$+ stream from the natural gas source (condensate). The combined streams are subjected to hydroprocessing conditions which involve hydrotreating and hydroisomerizing the hydrocarbons. Preferably, at least one of the catalyst components is a pre-sulfided catalyst, more preferably, a pres-sulfided Group VIII non-noble metal or tungsten catalyst. The hydroprocessing catalysts preferably include cobalt and/or molybdenum in catalytically effective amounts.

The sulfur in the $C_5$+ condensate keeps any pre-sulfided catalysts sulfided, which significantly decreases undesirable hydrogenolysis reactions. The sulfur compounds present in the $C_5$+ stream act as a hydrocracking suppressant, and minimize the amount of hydrocracking (hydrogenolysis), which would otherwise occur during the hydroprocessing reaction and form undesired $C_4$-products. The hydroisomerization step simultaneously lowers the sulfur level in the $C_5$+ condensate and, hence, the resulting $C_{5-20}$ product.

Hydrotreating

As used herein, "hydrotreating" or "hydrotreatment" is given its conventional meaning and describes processes that are well known to those skilled in the art. Hydrotreating refers to a catalytic process, usually carried out in the presence of free hydrogen, for desulfurization and/or denitrification of the feedstock, for oxygenate removal and for olefin saturation, depending on the particular needs of the refiner and on the composition of the feedstock. The sulfur is generally converted to hydrogen sulfide, the nitrogen is generally converted to ammonia and the oxygen converted to water, and these can be removed from the product stream using means well known to those of skill in the art. Hydrotreating conditions include a reaction temperature between 400° F.–900° F. (204° C.–482° C.), preferably 650° F.–850° F. (343° C.–454° C.); a pressure between 500 to 5000 psig (pounds per square inch gauge) (3.5–34.6 MPa), preferably 1000 to 3000 psig (7.0–20.8 MPa); a feed rate (LHSV) of 0.5 $hr^{-1}$ to 20 $hr^{-1}$ (v/v); and overall hydrogen consumption 300 to 2000 scf per barrel of liquid hydrocarbon feed (53.4–356 $m^3$ $H_2/m^3$ feed). The hydrotreating catalyst for the beds will typically be a composite of a Group VI metal or compound thereof, and a Group VIII metal or compound thereof supported on a porous refractory base such as alumina. Examples of hydrotreating catalysts are alumina supported cobalt-molybdenum, nickel sulfide, nickel-tungsten, cobalt-tungsten and nickel-molybdenum. Typically such hydrotreating catalysts are presulfided. Preferred hydrotreating catalysts of the present invention comprise noble-metal such as platinum and/or palladium on an alumina support.

Hydroisomerization

As used herein, "hydroisomerization" refers to processes which isomerize normal paraffins to form isoparaffins. Typical hydroisomerization conditions are well known in the literature and can vary widely. Isomerization processes are typically carried out at a temperature between 200° F. and 700° F., preferably 300° F. to 650° F., with a LHSV between 0.1 and 10, preferably between 0.25 and 5. Hydrogen is employed such that the mole ratio of hydrogen to hydrocarbon is between 1:1 and 15:1. Catalysts useful for isomerization processes are generally bifunctional catalysts that include a dehydrogenation/hydrogenation component and an acidic component. The acidic component may include one or more of amorphous oxides such as alumina, silica or silica-alumina; a zeolitic material such as zeolite Y, ultrastable Y, SSZ-32, Beta zeolite, mordenite, ZSM-5 and the like, or a non-zeolitic molecular sieve such as SAPO-11, SAPO-31 and SAPO-41. The acidic component may further include a halogen component, such as fluorine. The hydrogenation component may be selected from the Group VIII noble metals such as platinum and/or palladium, from the Group VIII non-noble metals such as nickel and tungsten, and from the Group VI metals such as cobalt and molybdenum. If present, the platinum group metals will generally make up from about 0.1% to about 2% by weight of the catalyst. If present in the catalyst, the non-noble metal hydrogenation components generally make up from about 5% to about 40% by weight of the catalyst.

Hydrocracking

As used herein, "hydrocracking" refers to cracking hydrocarbon chains to form smaller hydrocarbons. This is generally accomplished by contacting hydrocarbon chains with hydrogen under increased temperature and/or pressure in the presence of a suitable hydrocracking catalyst. Hydrocracking catalysts with high selectivity for middle distillate products or naphtha products are known, and such catalysts are preferred. For hydrocracking, the reaction zone is maintained at hydrocracking conditions sufficient to effect a boiling range conversion of the VGO feed to the hydrocracking reaction zone, so that the liquid hydrocrackate recovered from the hydrocracking reaction zone has a normal boiling point range below the boiling point range of the feed. Typical hydrocracking conditions include: reaction temperature, 400° F.–950° F. (204° C.–510° C.), preferably 650° F.–850° F. (343° C.–454° C.); reaction pressure 500 to 5000 psig (3.5–34.5 MPa), preferably 1500–3500 psig (10.4–24.2 MPa); LHSV, 0.1 to 15 $hr^{-1}$ (v/v), preferably 0.25–2.5 $hr^{-1}$; and hydrogen consumption 500 to 2500 scf per barrel of liquid hydrocarbon feed (89.1–445 $m^3$ $H_2/m^3$ feed). The hydrocracking catalyst generally comprises a cracking component, a hydrogenation component and a binder. Such catalysts are well known in the art. The cracking component may include an amorphous silica/alumina phase and/or a zeolite, such as a Y-type or USY zeolite. The binder is generally silica or alumina. The hydrogenation component will be a Group VI, Group VII, or Group VIII metal or oxides or sulfides thereof, preferably one or more of molybdenum, tungsten, cobalt, or nickel, or the sulfides or oxides thereof. If present in the catalyst, these hydrogenation components generally make up from about 5% to about 40% by weight of the catalyst. Alternatively, platinum group metals, especially platinum and/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst.

The catalyst particles may have any shape known to be useful for catalytic materials, including spheres, fluted cylinders, prills, granules and the like. For non-spherical shapes, the effective diameter can be taken as the diameter of a representative cross section of the catalyst particles. The effective diameter of the zeolite catalyst particles is in the range of from about 1/32 inch to about 1/4 inch, preferably from about 1/20 inch to about 1/8 inch. The catalyst particles will further have a surface area in the range of from about 50 to about 500 $m^2/g$.

A preferred supported catalyst has surface areas in the range of about 180–400 m2/gm, preferably 230–350 m2/gm, and a pore volume of 0.3 to 1.0 ml/gm, preferably 0.35 to 0.75 ml/gm, a bulk density of about 0.5–1.0 g/ml, and a side crushing strength of about 0.8 to 3.5 kg/mm.

The preparation of preferred amorphous silica-alumina microspheres for use as supports is described in Ryland, Lloyd B., Tamele, M. W., and Wilson, J. N., Cracking Catalysts, Catalysis, Volume VII, Ed. Paul H. Emmett, Reinhold Publishing Corporation, New York, (1960).

The hydroprocessing conditions can be varied depending on the fractions derived from the hydrocarbon synthesis step. For example, if the fractions include predominantly $C_{20}$+ hydrocarbons, the hydroprocessing conditions can be adjusted to hydrocrack the fraction and provide predominantly $C_{5-20}$ hydrocarbons. If the fractions include predominantly $C_{5-20}$ hydrocarbons, the hydroprocessing conditions can be adjusted to minimize hydrocracking. Those of skill in the art know how to modify reaction conditions to adjust amounts of hydrotreatment, hydroisomerization, and hydrocracking.

Sulfur Removal

The final product can be upgraded in separate vessels to remove sulfur and other undesirable materials. Methods for removing sulfur impurities are well known to those of skill in the art, and include, for example, extractive Merox, hydrotreating, adsorption, etc. Nitrogen-containing impurities can also be removed using means well known to those of skill in the art. Hydrotreating is the preferred means for removing these and other impurities.

Conversion of $C_{2-4}$ Products to $C_{5-20}$ products

In one embodiment, at least a portion of the $C_{2-4}$ products from the Fischer-Tropsch reaction are subjected to further processing steps, for example, olefin oligomerization, to provide an additional $C_{5-20}$ product stream. This product stream can also be hydroprocessed in combination with at least a portion of the $C_5$+ stream from the natural gas, and, optionally, in combination with at least a portion of the $C_{5-20}$ product stream from the Fischer-Tropsch synthesis and/or the product stream resulting from the processing of the Fischer-Tropsch wax.

Catalysts and reaction conditions for oligomerizing olefins are well known to those of skill in the art. Such catalysts and conditions are described, for example, in U.S. Pat. Nos. 6,013,851; 6,002,060; 5,942,642; 5,929,297; 4,608,450; 4,551,438; 4,542,251; 4,538,012; 4,511,746; 4,465,788; 4,423,269; 4,423,268; 4,417,088; 4,414,423; 4,417,086; and 4,417,087, the contents of which are hereby incorporated by reference. Any of the conditions known in the art for oligomerizing olefins can be used.

Once oligomerization products are recovered, a number of further processing steps can be performed. The olefins can be hydrogenated, for example, to form paraffins. The products from the oligomerization reaction include highly branched iso-olefins with a size range typically between $C_{12}$ and $C_{20}$ along with unconverted paraffins.

Isoolefins and/or the corresponding reduced isoparaffins in the naptha range from the oligomerization reaction tend to have relatively high octane values.

Conversion of $C_{20}$+ Products to $C_{5-20}$ products

In another embodiment, Fischer-Tropsch wax products are also isolated, and are treated to provide a $C_{5-20}$ product stream. This stream can also be hydroprocessed in combination with at least a portion of the $C_5$+ stream from the natural gas, and, optionally, in combination with at least a portion of the $C_{5-20}$ product stream from the Fischer-Tropsch synthesis.

What is claimed is:

1. A process for producing a hydrocarbon stream including $C_{5-20}$ normal and iso-paraffins, comprising:

a) isolating a methane stream from a natural gas source, wherein the methane stream is treated to remove sulfur-containing impurities;

b) isolating a $C_{5+}$ stream from the natural gas source, wherein the $C_{5+}$ stream includes sulfur-containing impurities;

c) converting at least a portion of the methane stream into syngas, and using the syngas in a Fischer-Tropsch synthesis;

d) isolating a product stream including $C_{5-20}$ hydrocarbons from the Fischer-Tropsch synthesis;

e) combining at least a portion of the $C_{5-20}$ stream from the Fischer-Tropsch synthesis with at least a portion of the $C_{5+}$ stream from the natural gas source, to prepare a blended stream containing less than about 200 ppm sulfur; and f) subjecting the combined streams to hydroprocessing conditions.

2. The process of claim 1, wherein the hydroprocessing conditions involve the use of hydrotreatment and/or hydroisomerization catalysts.

3. The process of claim 1, wherein the hydroprocessing conditions involve using an acidic catalyst.

4. The process of claim 2, wherein the catalysts comprise a pre-sulfided catalyst.

5. The process of claim 4, wherein the pre-sulfided catalysts comprises between about 0.1 and 10 wt % sulfur.

6. The process of claim 2, wherein the catalysts comprise a Group VIII non-noble metal, cobalt, molybdenum or tungsten.

7. The process of claim 1, wherein the sulfur compounds present in the $C_5$+ stream act as a hydrocracking suppressant in the hydroprocessing step.

8. The method of claim 1, further comprising treating the hydroprocessed product to lower the concentration of sulfur compounds after the hydroprocessing step.

9. The method of claim 2, wherein the hydroprocessing catalyst comprises cobalt and/or molybdenum in catalytically effective amounts.

10. The method of claim 3, wherein the acidic component comprises a silica-alumina support.

11. The method of claim 1, further comprising isolating Fischer-Tropsch wax products from the Fischer-Tropsch synthesis.

12. The method of claim 11, further comprising treating the wax products to provide an additional $C_{5-20}$ product stream.

13. The method of claim 11, further comprising hydroprocessing the additional $C_{5-20}$ product stream in combination with at least a portion of the $C_5$+ stream from the natural gas.

14. The method of claim 1, further comprising isolating a $C_{2-4}$ fraction from the Fischer-Tropsch synthesis.

15. The method of claim 14, further comprising converting at least a portion of the $C_{2-4}$ fraction to an additional $C_{5-20}$ fraction.

16. The method of claim 15, further comprising hydroprocessing the additional $C_{5-20}$ fraction in combination with at least a portion of the $C_5$+ stream from the natural gas.

* * * * *